US011712734B2

(12) United States Patent
Steiner

(10) Patent No.: US 11,712,734 B2
(45) Date of Patent: Aug. 1, 2023

(54) TRANSFER PRESS HAVING A C-SHAPED RAM

(71) Applicant: FRITZ WERNER INDUSTRIE-AUSRÜSTUNGEN GMBH, Geisenheim (DE)

(72) Inventor: Andreas Steiner, Oestrich-Winkel (DE)

(73) Assignee: FRITZ WERNER INDUSTRIE-AUSRÜSTUNGEN GMBH, Geisenheim (DE)

( * ) Notice: Subject to any disclaimer, the term of this patent is extended or adjusted under 35 U.S.C. 154(b) by 32 days.

(21) Appl. No.: 16/097,260

(22) PCT Filed: Apr. 28, 2017

(86) PCT No.: PCT/DE2017/100352

§ 371 (c)(1),
(2) Date: Oct. 28, 2018

(87) PCT Pub. No.: WO2017/186234

PCT Pub. Date: Nov. 2, 2017

(65) Prior Publication Data

US 2019/0118242 A1 Apr. 25, 2019

(30) Foreign Application Priority Data

Apr. 28, 2016 (DE) ..... 10 2016 005 145.0
May 2, 2016 (DE) ..... 10 2016 005 322.4

(51) Int. Cl.
*B21D 43/05* (2006.01)
*B21D 37/08* (2006.01)

(52) U.S. Cl.
CPC ..... *B21D 43/055* (2013.01); *B21D 37/08* (2013.01)

(58) Field of Classification Search
CPC ..... B21D 43/055; B21D 37/08; B21D 43/04; B21D 43/05; B21D 24/005; B30B 15/047
USPC ..... 72/406.11
See application file for complete search history.

(56) References Cited

U.S. PATENT DOCUMENTS 3,596,498 A * 8/1971 Bradlee ..... B21D 43/055 72/405.13
3,683,665 A * 8/1972 Bradlee ..... B21D 43/055 72/405.07
3,728,902 A * 4/1973 McGaughey ..... B21D 43/055 74/56
4,166,372 A * 9/1979 Knight ..... B21D 43/055 72/335
4,562,719 A * 1/1986 Budrean ..... B21D 51/54 72/349
4,602,541 A * 7/1986 Benzinger ..... B21D 28/04 83/137

(Continued)

FOREIGN PATENT DOCUMENTS

EP 1797973 A1 * 6/2007 ..... B21D 43/105

*Primary Examiner* — Shelley M Self
*Assistant Examiner* — Smith Oberto Bapthelus
(74) *Attorney, Agent, or Firm* — FisherBroyles, LLP; Robert Kinberg

(57) ABSTRACT

The invention relates to a transfer press for successive forming and demoulding of work pieces by means of upper and lower tools in dies, wherein the upper tools are attached to a ram head, while the lower tools are installed on a ram foot. The ram head and the ram base are rigidly connected to each other and form a ram.

16 Claims, 5 Drawing Sheets

(56) References Cited

U.S. PATENT DOCUMENTS 4,655,071 A * 4/1987 Allweier ..... B21D 22/21
72/345

* cited by examiner

TRANSFER PRESS HAVING A C-SHAPED RAM

PRIORITY APPLICATIONS

This application is a U. S. National Stage Filing under 35 U.S.C. 371 from International Application No. PCT/DE2017/100352, filed on 28 Apr. 2017 and published as WO 2017/186234 on 2 Nov. 2017, which claims the benefit of priority to German Patent Application No. 10 2016 005 145.0 filed 28 Apr. 2016, and German Patent Application No. 10 2016 005 322.4 filed 2 May 2016, which applications and publication are incorporated herein by referenced in their entirety.

The invention relates to a transfer press for the successive forming and demoulding of work pieces with the aid of upper and lower tools in dies. The upper tools are fastened to a ram main, while the lower dies are installed on a ram foot. The ram head and the ram foot are rigidly connected and form a ram.

Background and State of the Technology

The invention relates to the field of transfer presses for recasting work pieces, in particular from metal sheets. Mechanical forming belongs to the main group of manufacturing processes according to DIN 8580 and describes the controlled deformation of a solid body. Mass and substance cohesion are preserved. The mechanical processing machines used for the recast operation are generally referred to as press. Depending on the degree of deformation, which quantitatively expresses the change in shape, the forming process may need to be carried out in several stages to realize the production of a work piece. In this case, special transfer presses are used, which transport the work piece automatically through the individual forming stages.

As part of the sheet metal processing deep drawing is utilised, which belongs to the sub-group of mechanical forming. In principle, the ronden- or bowl-shaped work piece is threaded by the so-called drawing punch and pulled through a die. This results in a change in the parameter diameter, wall thickness and height depending on the selected tool geometry.

In the case of transfer presses, the drawing dies are usually fastened to an upper ram (the so-called press ram) for forming. It is stored within the press frame and has mechanical or hydraulic drive to provide the force required for forming during the required travel. The die is located in the tool block on the press table, to which the press ram performs an oscillating relative movement.

In order to ensure the work piece's return after the forming process to the transfer system, and to avoid it getting stuck in the die, mechanical support from demoulding tools is often required. For this purpose, the transfer press has lower tools or lower punches, which push the work piece out of the die. A lower ram drives the lower tools/punches.

State of the art knows several such transfer presses. For example, U.S. Pat. No. 4,166,372 A and 4,655,071 A describe transfer presses for processing cup-shaped metal work pieces, wherein a plurality of upper punches are installed on a ram main, while the lower tools are driven individually via a camshaft. In U.S. Pat. No. 4,562,719 A, the transfer press utilises top tools with different diameters along their height in order to incorporate steps into the metallic work piece. A ram main drives the upper tools. The lower tools can be lifted, either individually or together. In contrast, U.S. Pat. No. 2,539,807 A proposes a transfer press in which the upper tools are controlled jointly by a ram head, while the lower tools are controlled jointly by a ram foot. In order to set different drawing speeds, DE 2743642 A1 proposes a transfer press, in which both, the punches as upper tools and the lower tools as ejectors, are driven separately. However, there is a disadvantage which is the complex drive control.

According to the state of the art, separate mechanical assemblies sometimes realize successive working steps of forming and demoulding.

Typically, the transfer presses include a press ram for receiving the draw punches as an assembly. Independently, a lower ram, or a plurality of individually controllable lower rams with corresponding punches, are provided for removal from the mould.

The kinematics of the respective assemblies for forming as well as demoulding must be ensured by an associated drive.

According to the state of the art, it is preferred that a central drive is distributed to both modules. However, the geometric distance between the press ram and the lower rams for demoulding results in a complex mechanical coupling. Thus, gear (in particular gear pairs), shafts (in particular universal joints and shafts), chains, belts and clutches are used.

Due to developments in drive technology, electronically synchronized individual drives are replacing exclusively mechanical couplings for the respective modules more frequently.

Both, the drive by mechanical couplings as well as separate electromechanical individual drives, are characterized by a considerable amount of effort.

Another disadvantage in the known transfer presses is the size of the ram. In order to ensure a high guiding accuracy of the press ram and the demoulding ram, the respective ram height should be close to the ram width or even larger. Consequently, in known transfer presses the dimensions of press racks are considerably large.

Objective of the Invention

One objective of the invention was to provide a transfer press that improves on the mentioned drawbacks of state of the art technology. In particular, it was an aim to develop a transfer press, which is characterized by compact design, simplified drive and high manufacturing precision.

SUMMARY OF THE INVENTION

This objective is accomplished according to the present invention by independent claims. The dependent claims represent preferred embodiments of the transfer press according to the invention and its usage.

In a preferred embodiment, the invention relates to a transfer press for carrying out at least two forming and demoulding steps of a work piece, comprising a press table with at least two dies for receiving the work piece, a transfer system for transfer of the work piece between the dies, and at least two upper tools and at least two lower tools that can perform a relative movement to the press table. So in a first forming step, the work piece can be formed by a first upper tool in a first die, and in a first demoulding step, the work piece can be removed from the mould by a first lower tool. In a transfer step the work piece can be transported by the transfer system from the first die to the second die, in a second forming step, the work piece can be converted from a second upper tool in a second die. During a second demoulding step, the work piece can be removed from the second die by a second lower tool, the upper tools are installed on a ram main, the lower tools are installed on a ram base and the ram and the ram butt are rigidly connected together to form a ram.

For the purposes of the invention, a 'work piece' refers to the component that is processed during several forming processes in the transfer press. Preferred work pieces are sheets, in particular sheet metal bowls, which are pulled successively.

The 'upper tools' are tools of the transfer press that are used to recast the work piece. These are preferably drawing punches. By cooperating with corresponding dies, these allow the deep drawing of work pieces. The 'dies' denote the moulds formed in the tool block on the press table by means of cut outs, as counter-moulds to the upper tools. For example, for the preferred drawing of sheet metal bowls, the dies are circular, with diameter of the dies being at least twice the sheet thickness of the resulting drawing stages than the diameter of the upper tools or drawing dies.

The 'lower tools' carry out the demoulding process. The lower tools are especially ejection punches. The lower tools are adjusted to the size of the dies and ensure that any work pieces that may be present in the dies are pushed out when inserting the lower tools.

It is preferred that in the transfer press, according to the invention, the forming results from a relative movement of the upper tools from top to bottom. For the purpose of the invention, top and bottom are defined according to gravity. After forming, the upper tools perform a retraction movement from bottom to top, preferably at the same time the lower tools remove work pieces from the dies by an upward movement. An expert will recognize that a reverse construction of the transfer press, where the forming occurs from bottom to top, is also suitable for implementing the proposed invention. In that case, the description of the invention would reverse the directions of the upper and lower tools.

According to the invention, the work piece undergoes at least two forming and demoulding processes while passing through the transfer press. For this purpose, the transfer press comprises a transfer system. With the aid of the transfer system, the work piece is conveyed onwards after a first forming and removal step in a first die has taken place. Next, a second forming step can take place in a second die. An expert will be familiar with suitable transfer systems.

For example by demoulding, the work piece can be transferred into a swinging body, which oscillates between two positions. After the first demoulding step from the first die, the work piece is transferred to the swinging body, which aligns the work piece with the second die by a pre-swing (transfer step). The alignment thus preferably means a positioning of the work pieces, for instance above the respective die, so that a forming in the respective die can take place.

Continuous processing is carried out for optimal utilization of the transfer press, wherein the work pieces pass through the transfer press continuously. While the second forming step of a first work piece takes place in the second die, a second successive work piece is formed in the first die.

During the preferred operation of the transfer press, according to the invention, the forming steps take place simultaneously for several work pieces according to their positioning in the dies. The successive forming of a work piece that passes through the transfer press is preferably achieved by a different dimensioning of the upper tools. For example, longer or shorter drawing punches can be used. During operation of the transfer press, the various upper tools are always guided simultaneously in a relative movement to the press table. The same applies to the lower tools, which simultaneously push out or demould several work pieces from the respective dies.

For this purpose the transfer press, according to the invention, comprises a ram head, on which the upper tools are mounted, and a tappet foot for the lower tools. The ram head and the ram base are rigidly connected to one another. As a result, according to the invention, there is only one displaceable component for controlling the kinematics of the upper and lower tools in the transfer press. For the purposes of the invention, the rigid compound of ram head and ram base is also referred to as a ram assembly or ram.

This construction has a number of advantages over state of the art solutions. According to current technology, a main ram in the form of a monobloc usually actuates the top tools. This must be designed for high power transmission, since the required working capacity for forming is significantly larger than for demoulding work. In addition, current technology transfer presses separately comprise one or more rams in order to operate the demoulding tools. To drive the main and the demoulding ram(s) requires, as explained above, either a complex mechanical coupling of a central drive, or the use of multiple electronically synchronized individual drives.

By using the ram according to the invention, only a simple drive is necessary. This controls both the lifting and lowering of the upper and lower tools. According to the invention, it has been recognized that the kinematics of the transfer press can be significantly simplified by a mechanical, rigid connection of a ram head (for the upper tools) and a ram foot (for the lower tools). The invention thus allows a reduction of the effort and costs for production, operation and maintenance of the transfer press.

In addition, according to the invention, the ram allows a surprisingly compact design of the transfer press. In order to ensure a secure guidance of the upper and lower tools in state of the art applications, the rams are preferably dimensioned in a guidance ratio, in which the ram height is almost as large or larger than the ram width. For the purposes of the invention, the term height or vertical extent (e.g. of the ram or the transfer press), preferably relates to the dimension in which the upper and lower tools are moved up and down relative to the press table. The width or lateral extent (e.g. of the ram or the transfer press) however, preferably indicates the direction along which at least two upper or lower tools are lined up side by side, and on which the work pieces successively pass through the intended forming steps in the transfer press.

For many applications, for example for drawing sheet metal bowls for cartridge cases, it is preferable to use more than two aligned upper and lower tools for successive forming and removal steps. As a result, a minimum width of the ram for the upper and lower tools is set in the current technology. Each individual ram in the current technology has at least one height that corresponds to this width A state of the art transfer press with such separate ram assemblies is therefore characterized by a large overall height.

In contrast the proposed rigid connection of the ram head with the ram foot allows a clear and compact design. The relevant ram height for a stable guidance in this case is equal to the total height of the ram main up to the ram foot. As a result, the ram, according to the invention, still ensures precise guidance of the upper and lower tools even for a dimensioning of the ram when height corresponds to the width.

For the purposes of the invention, the rigid compound of the ram head with the ram base preferably refers to any mechanical connection, which does not allow any relative movement of the two components to one another. The tappet, according to the invention, may be a monobloc or composed of several components for this purpose.

In a preferred embodiment, the ram head and the ram base are rigidly connected to each other by means of two side parts. The side parts are preferably vertical connections between the ram head and the ram base, which are fixed to the respective outer, lateral ends of the ram head and foot. By means of such a rigid connection, a particularly stable ram can be constructed with minimal material expenditure, according to the invention. The side parts can hereby be shaped differently and fastened at different positions of the ram head and foot. For example, the rams could be connected by two side parts in the form of tie rods, which extend on both sides through the press table. A particularly favourable power transmission and mechanical coupling of the ram head and foot are characteristics of such a rigid connection.

On the other hand, openings in the press table are required in this embodiment, whereby its capacity for absorbing forces is impaired. Especially for power-consuming forming presses, such as in the case of deep drawing of sheet metal bowls for cartridge cases, homogeneous press tables are advantageous.

In a preferred embodiment of the invention, ram head, ram base and press table are situated in a plane, wherein the side parts for rigid connection of ram head with ram base form a C-shape. Thus, side parts from ram head to ram base are able to pass before or behind the press table. For the purposes of the invention, the configuration of side parts in a C-shape preferably means that they do not connect ram head and ram foot directly vertically, but instead diffract a C-shape in the side profile of the transfer press. The indication of direction in front of or behind the press table refers to the depth of the transfer press. This is the extent that is orthogonal to the side and height. In this embodiment, an excellent mechanical power transmission can be implemented from the ram main to the ram base without the need for any openings in the press table. Surprisingly, according to the invention, the embodiment is thus characterized with a low material cost and weight, but compact and particularly stable construction of the ram.

In a preferred transfer press, the ratio of the width of the ram to the height of the ram is 1 to at least 0.5, preferably 1 to at least 1. The height of the ram is measured preferably from the upper end of the ram head to the lower end of the ram base, whereas the width corresponds to the distance between the outermost lateral ends of the ram. The preferred size ratios allow a particularly stable guidance. Accordingly, bearings for guiding the ram can be installed laterally on the ram main and foot, respectively, which have a distance of almost the width of the ram, or even larger. The greater the vertical distance between the bearings to each other, the more effective one can avoid tilting or the occurrence of lateral forces. On the other hand, the ram height contributes significantly to the overall height of the transfer press. The aforementioned parameters represent optimized values with regards to space-saving design and high guiding stability.

In a preferred embodiment of the invention, the transfer press comprises a central drive motor as a starting point of a drive train, which controls the movement of the ram via at least one connecting rod. Advantageously, the upper and lower tools of the transfer press can be moved by a single drive train. Preferably, the (at least one) connecting rod that is used for power transmission is attached to the ram at the upper end of the ram head. Since a larger force is necessary for forming than for demoulding, this positioning is mechanically advantageous.

Particularly preferably is to use at least two connecting rods, which are installed at the centres of gravity on both sides of the ram main. The two-point arrangement can counter tilting moments particularly effective, which can occur during the power transmission to the ram.

The at least one connecting rod is preferably offset via a crankshaft by a drive train in a vertical relative movement to the press table. As a drive for the crankshaft various engines of current technology can be used, such as servomotors, asynchronous motors or torque motors.

In a preferred embodiment of the invention, the ram head and the ram base are guided in a frame of the transfer press by means of linear bearings. As a result, off-centre stress on the ram can be effectively absorbed. For this purpose, the frame of the transfer press (press frame) can for example have a rectangular shape, which ensures high stability.

In a preferred embodiment, the linear bearings are profile rail guides, preferably roller circulation units, and/or hydrodynamic plain bearings.

Profile rail guides are well known in the state of the art. At these bearings rolling elements roll on a guide rail and within a carriage. Preferably, the guide rail is attached to the frame, while the carriage is fixed to the ram. As rolling elements balls (recirculating ball units) or rollers (roller circulating units) are used in profile rail guides. During the translational movement, the rolling elements are deflected in the carriage, so linear movement (stroke) is possible at a length that corresponds to the rail. For the transfer press roller circulating units are particularly suitable because they are characterized by high load capacity and resilience. Since the linear guide ways are standardized bearing units, they can be exchanged particularly easily and inexpensively in the event of wear. Furthermore, profile rail guides and in particular roller circulation units are characterized by a high-precision and backlash-free design of the bearing.

A particularly advantageous storage is possible with a lateral arrangement of the profiled rail guides on the ram, since these withstand maximum stress. However, a high manufacturing accuracy in terms of the spacing between ram and frame is required. Alternatively, the profile rails can for example also be attached to the back of the press frame, whereby the high requirements of a lateral fitting of the ram in the frame are dropped.

As further alternative hydrodynamic bearings can be selected. These generally have greater tolerances on the accuracy of fit between the ram and guide within the frame and are also characterized by high lifetimes. With regard to precision, zero backlash and load capacity, however, the profiled rail guides have surprisingly proven to be a particularly preferred embodiment.

In a preferred embodiment of the invention, the transfer press comprises four linear bearing points. Each guides the ram head and the ram foot laterally in a frame of the transfer press. The guidance accuracy and load capacity of eccentric loads is particularly high in this bearing.

In a preferred embodiment of the invention, the ram is adjustable without play in a frame of the transfer press by means of lateral wedge adjustments. The wedge adjustments are preferably a separate assembly, which is installed between the press frame and one side of the tappet guide. Preferably, the transfer press has two wedge adjustments; one at the height of the ram head and one at the level of the ram foot. The wedge displacements comprise two wedges displaceable relative to one another, wherein a vertical displacement of the wedges leads to an increase or reduction of the lateral extent of the wedge adjustment. Due to the wedge adjustments, a predefined installation status can be implemented in a simple and precise manner. The embodiment thus allows an exact lateral fitting of the ram in the frame to ensure zero backlash. Such a construction for fitting the ram is particularly advantageous in the use of lateral profiled rail guides, such as the roller circulation units.

In a preferred embodiment of the invention, each side part of the ram assembly exhibits a key for moving the ram head and/or the ram base in depth and a pivot point for rotation of the ram head and/or the ram base about a horizontal axis. These preferred adjusting mechanisms allow the top and bottom tools to achieve perfect concentricity. Preferably, the feather keys (preferably in each case a feather key on each side of the ram) cause a displacement of the ram head to the front, or to the rear, relative to the ram base. Furthermore, a pivot point, which can be implemented for example by a bolt, causes a rotation of the ram base about a horizontal axis, so that the lower tools can be aligned with the correct angle to the upper tools. Likewise, it may also be preferable to use the feather keys in the tappet foot and to align the tappet head over a pivot point: the degrees of freedom of the preferred construction advantageously allow the tappet head to be aligned with the tappet foot so that the corresponding upper and lower tools are perfectly inserted into the dies of the press table. It has been found that the adjusting construction can compensate for manufacturing tolerances of the components within the ram assembly in a particularly effective manner. After alignment, the parts are preferably pinned together so that they form a rigid arrangement.

In a preferred embodiment of the invention, the transfer system for the work pieces comprises a swing body. As explained above, the forming of the work pieces is preferably carried out in dies, which are located in a tool block on a press table. The press table is firmly connected to the press frame, so that the frame can absorb the pressing force during the forming of the work piece in the dies. After forming, the work piece is removed from the dies by an upward movement of the ram by means of the lower tools. In this case, it is preferable to push the work pieces into gripper jaws of the swinging body. With the aid of eccentrics, the swing body is oscillated between two positions during the operation of the transfer press. After the demoulding step but before the next forming step, the work pieces are present in the swinging body and transported by a transfer step from the first to the second position (pre-swinging). After the forming step and before the next demoulding step, the swinging body swings back without work pieces from the second to the first position. The sequence of processing steps is thus carried out so that there is always a transport of the work pieces in the transfer direction. As a result, a work piece passes through successive forming and demoulding steps from the first to the respective next die or die station until it can be ejected from the transfer press. A die station can contain a plurality of dies for a forming step, which are arranged one below the other.

In a further embodiment of the invention, the transfer press comprises at least two groups with at least two, preferably at least four, top tools with aligned at least two groups with at least two, preferably at least four, sub-tools, so that the transfer press can process work pieces in at least two tracks simultaneously. A track preferably designates an arrangement of the tools for successive forming in two or more steps from an incoming work piece to the desired formed work piece. By arranging at least two tracks in a transfer press, the productivity is exactly doubled within the same time. Through the ram (according to the invention), this embodiment can advantageously achieve a compact design as well. In known state of the art technology transfer presses, widening the main or press ram to dispose multiple tracks would result in an equally large increase in both the height of the main tappet and the one or more lower tappets for demoulding. With this ram however, according to the invention, the dimensioning of the press can be kept significantly smaller without jeopardizing a healthy guidance ratio of the ram. The advantages of the proposed structure of the ram thus lead to excellent results, in particular when applied for high-performance transfer presses with multiple tracks.

In a preferred embodiment of the invention, the transfer press is particularly suitable for forming cup-shaped work pieces made of sheet metal, particularly for the production of cartridge cases. For this purpose, it is particularly preferred that the ram has a width and a height between 500 mm and 1500 mm, more preferably between 800 mm and 1200 mm, and most preferably between 950 mm and 1050 mm. In this case, it is particularly preferable to choose a guidance ratio of the ram width to height of 1 to at least 0.5, more preferably 1 to at least 1. Due to the dimensions mentioned, the transfer press is particularly suited for providing for the high forces during the forming of cup-shaped work pieces made of sheet metal, particularly preferably in the production of cartridge cases. In these instances, forming forces per drawing station are preferably generated by the transfer press of at least 30 kN, more preferably at least 40 kN, most preferably at least 50 kN. Preferred drawing punches have diameters between 5 and 20 mm, particularly preferable between 8 and 12 mm.

The invention thus also relates in particular to the use of a transfer press according to the invention, or preferred embodiments, for forming cup-shaped work pieces from sheet metal, preferably for the production of cartridge cases.

It should be noted that various alternatives to the described embodiments of the invention might be used to carry out the invention and to arrive at the solution according to the invention. The transfer press according to the invention is therefore not restricted in its embodiments to the above-preferred embodiments. Rather, a variety of design variants is conceivable that may differ from the illustrated solution. The aim of the claims is to define the scope of protection for the invention. The scope of protection of the claims is directed to cover the transfer press of the invention, its use, as well as equivalent embodiments thereof.

DETAILED DESCRIPTION OF THE PICTURES

Figure 1:
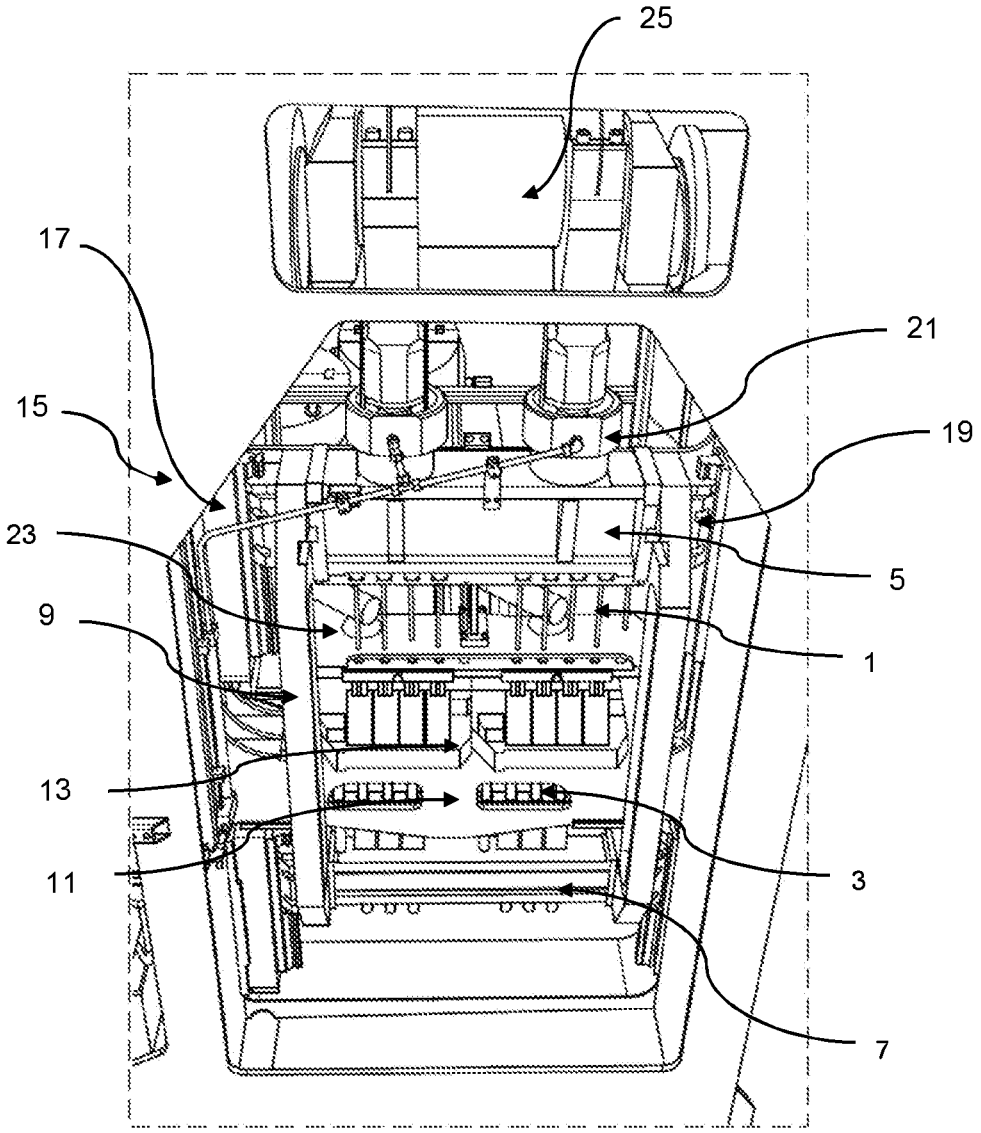
FIG. 1 Schematic 3D front view of a preferred embodiment of the transfer press for the representation of the ram FIG. 2 Schematic sectional view of a preferred embodiment of the transfer press in the plane of forming the work pieces FIG. 3 Schematic sectional view of a preferred embodiment of the rolling circulating units and feather keys for attachment of the ram head FIGS. 4*a*, 4*b* Schematic front and side sectional views and FIG. 4*c* an end view of a preferred embodiment of the transfer press to illustrate the alignment of the ram head to the ram foot.

FIG. 1 shows a schematic 3D front view of a preferred embodiment of the transfer press for the representation of the ram. The preferred transfer press is used for forming cup-shaped work pieces made of sheet metal. For this purpose, the transfer press comprises upper tools 1 and lower tools 3. In the preferred embodiment shown, the transfer press has two tracks for processing the work pieces. The left and right lanes each comprise five upper tools or drawing punches 1, as well as five lower tools or demoulding dies 3, which are aligned therewith. By a downward movement of the upper tools 1, the work pieces are reshaped or drawn into dies. An upward movement of the lower punch 3 ensures removal of the work pieces from the dies. The dies (not visible) are for the purpose of forming in a tool block 13 on the press table 11. Transport of the work pieces from one die to the next takes place by means of a transfer system 23.

During operation of the transfer press clocked movement of the upper tools 1 takes place downwards for forming, and for the lower tools 3 upwards for demoulding. Between these steps, the transfer system 23 each oscillates between two positions to ensure further transport of the work pieces.

A ram implements the common vertical relative movement of the upper and lower tools 1 and 3 to the press table 11. The ram comprises a ram head 5 for attachment of the upper tools 1 and a ram base 7 for fixing the lower tools 3. Two side parts 9 rigidly connect the ram head 5 and the ram foot 7 to each other. The ram head 5, the ram foot 7 and the press table 11 are present in one plane, whereas the side parts 9 are guided from the tappet head 5 to the tappet foot 7. In the side view of the transfer press, the side parts 9 therefore have a corresponding C-shape.

The drive of the moulded ram is accomplished via two connecting rods 21 by means of a crankshaft 25, wherein the connecting rods 21 preferably attack each track in the centre of gravity to ensure a stable power transmission. The ram is movably supported in the press frame 15 by means of four lateral roller circulation units 19 in order to allow a precise vertical guidance. Two one-sided wedge adjustments 17 effect lateral fitting of the ram in the guide frame of the press frame 15.

Advantageously, the ram may be driven via a single drive motor (not shown) that transmits the movement to the crankshaft 25 via, for example, a belt transmission, a flywheel, a clutch brake combination, and a planetary gear. Separate control of the upper and lower tools 1, 3 is not necessary because the ram head 5 is rigidly connected by means of the side parts 9 with the tappet foot 7.

Figure 2:
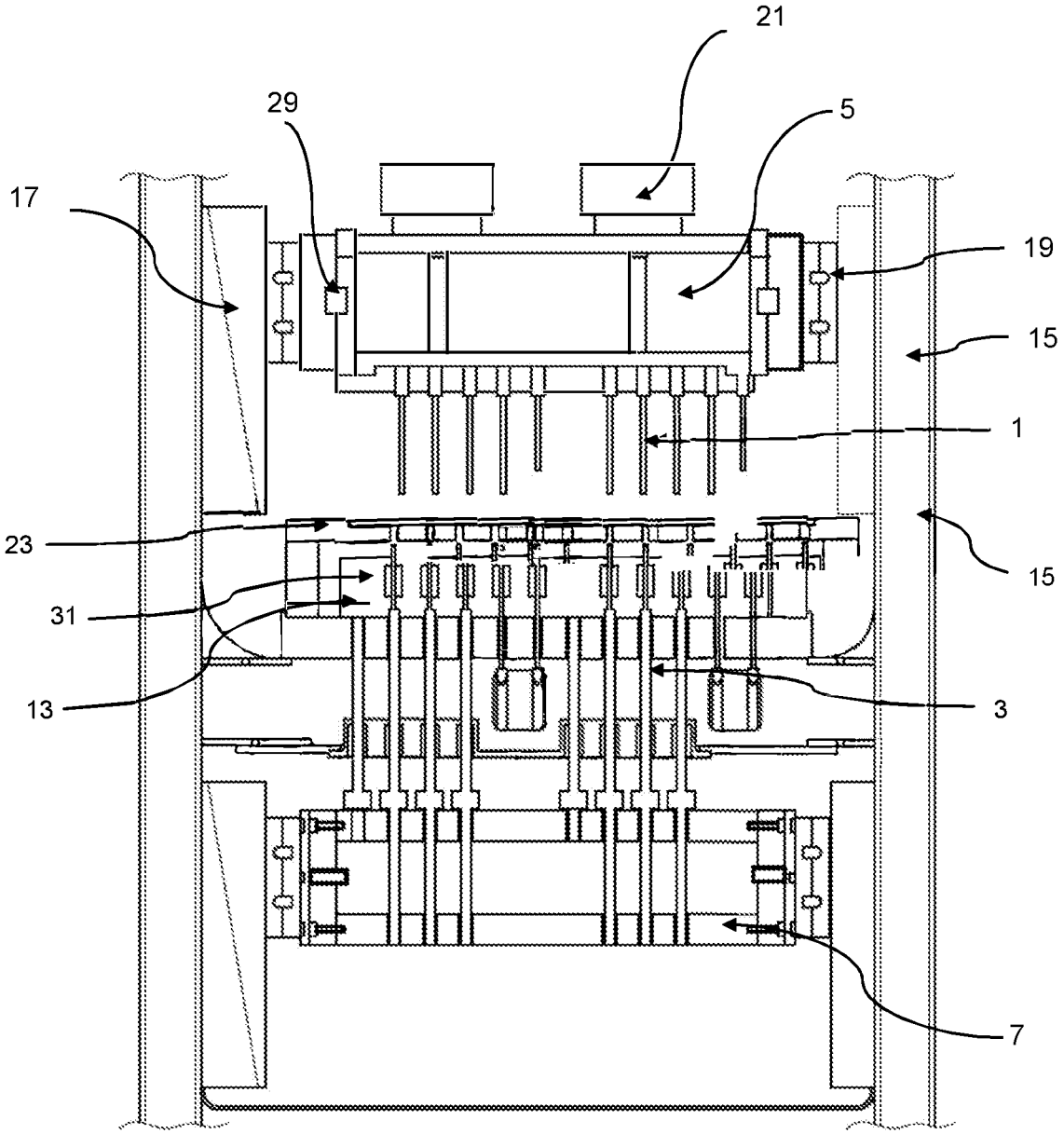

FIG. 2 shows a schematic sectional view of a preferred embodiment of the transfer press in the plane of forming the work pieces. In the sectional view it can be seen that the ram main 5 is present on the left side via wedge adjustments 17 on the frame 15. The same applies to the tappet foot 7. This allows a particularly simple fitting to be implemented. Roller circulation units 19 effect the vertically guided movement of the ram in the press frame 15.

Figure 3:
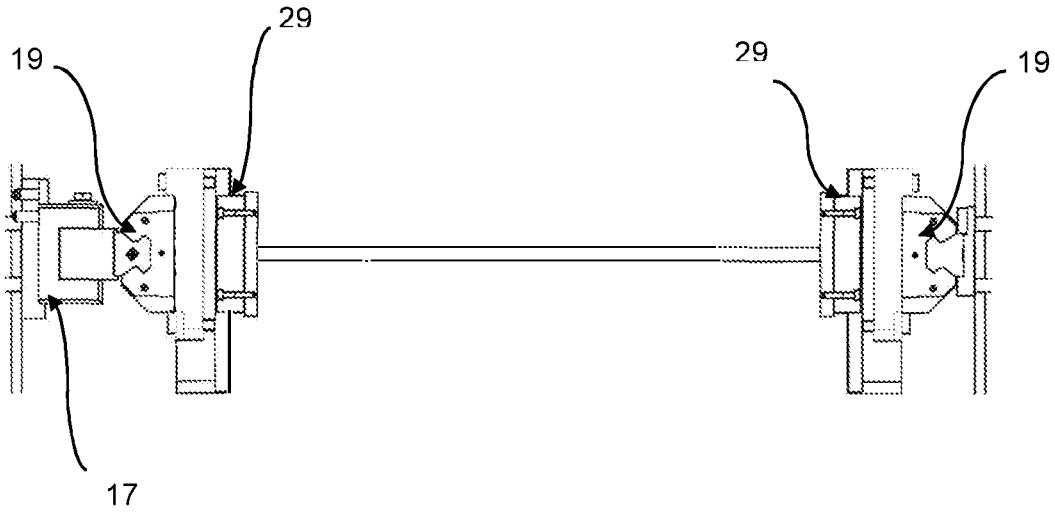

FIG. 3 shows a detailed view of the roller circulation units 19 and the key 29. By means of the key 29, the ram head 5 can be moved in the depth of the transfer press, forward and backward, relative to the ram foot 7.

Figure 4A:
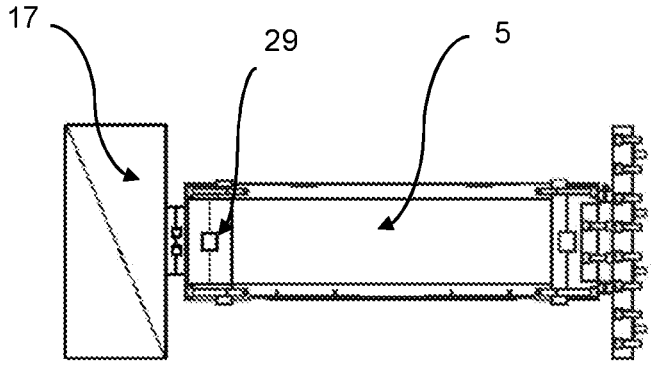
Figure 4B:
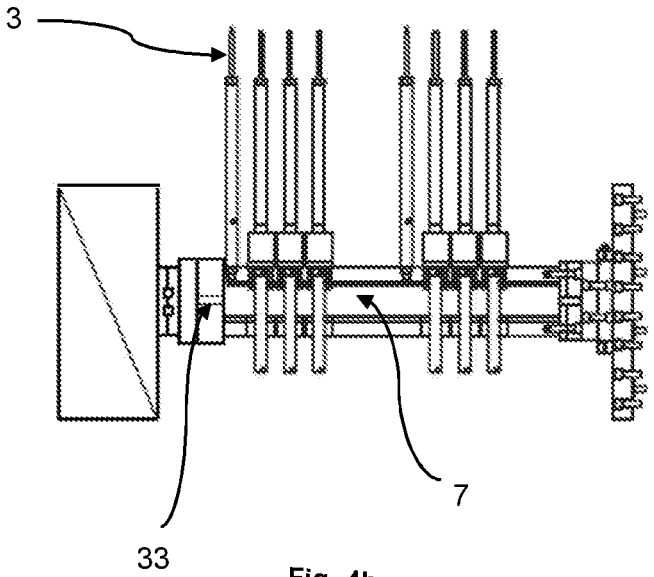
Figure 4C:
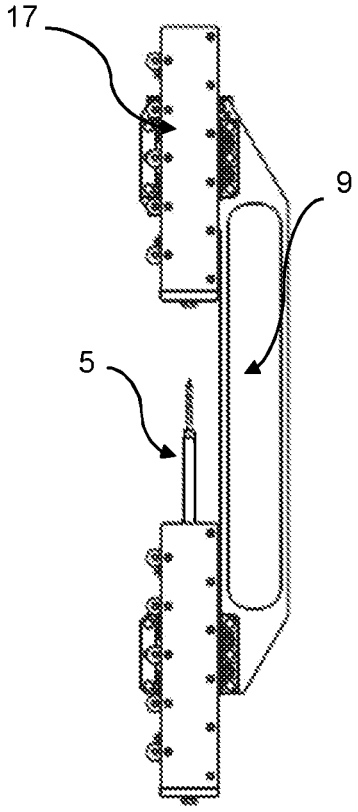

The orientation of the ram main and tappet foot 5 and 7 is illustrated in FIGS. 4*a*, 4*b* and 4*c*. FIG. 4*a* is a front sectional view, FIG. 4*b* is a side view and FIG. 4*c* is an end view. Through the use of two left-side wedge adjustments 17, a lateral displacement of the ram head 5 and the ram foot 7 is possible. Here, by a vertical displacement of the wedges of the wedge adjustment 17 their width is adjusted, so that the ram is fitted without play in the lateral frame of the press frame 15. The feather key 29 allows an adjustment of the ram head 5 in depth relative to the ram foot 7. In addition, the bolt 33 allows tilting of the ram foot 7, and thus the lower tools 3, about a horizontal axis. As illustrated in the side view 4*b*, the lower tools 3 can thereby be aligned concentrically with the dies and upper tools 1.

Figure 5A:
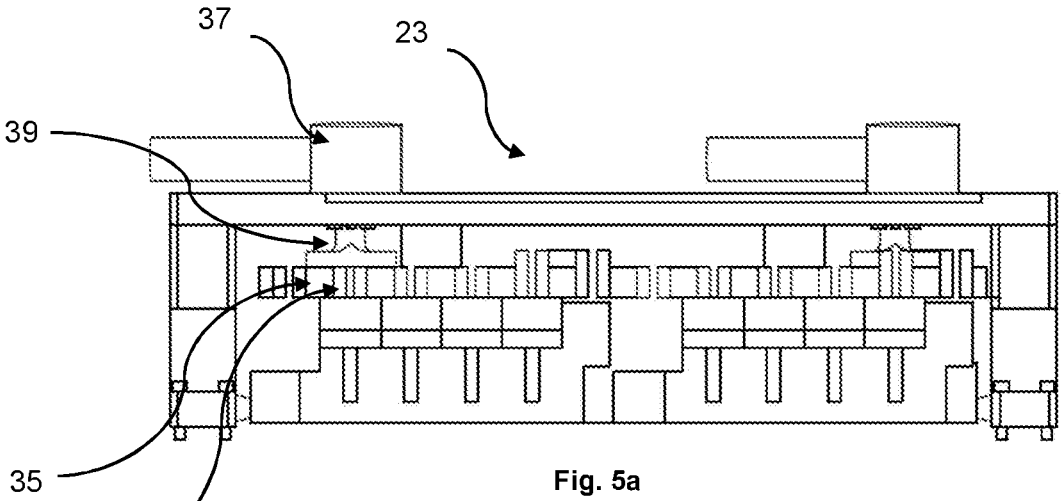
FIG. 5 Schematic representation of a preferred embodiment of the transfer system of the transfer press
Figure 5B:
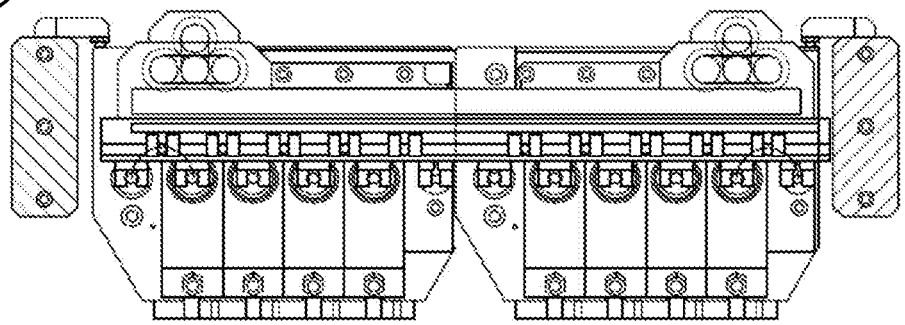

FIGS. 5*a* and 5*b* shows, respectively, side and top views of a schematic representation of a preferred embodiment of the transfer system 23 of the transfer press. This comprises a swing body 35 with gripper jaws 41 for receiving the work pieces. After forming, a work piece is removed from the dies by an upward movement of the ram by means of the lower tools 3. In this case, it is preferable for the work pieces to be pushed into gripper jaws 41 of the swing body 35. With the aid of servomotors 37 and eccentrics 39, the swing body 35 can be oscillated between two positions during the operation of the transfer press. After the demoulding step and before the next forming step, the work pieces are present in the swing body and are trans-ported by a transfer step from the first to the second position (pre-swinging). After the forming step and before the next demoulding step, the swing body swings back without work pieces from the second to the first position. The sequence of processing steps is thus carried out in a way that there is always a transport of the work pieces in the transfer direction.

LIST OF REFERENCE NUMBERS

1 upper tools
3 lower tools
5 ram head (ram main)
7 ram foot (ram base)
9 side parts
11 press table
13 tool block
15 press frame
17 wedge adjustments
19 roller circulation units
21 connection rods
23 transfer system
25 crankshaft
29 feather key
31 die
33 bolt
35 swing body
37 servomotors
39 eccentric
41 gripper jaws

The invention claimed is:

1. A transfer press for carrying out at least two forming and demoulding steps for producing a work piece, comprising:

a tool block on a press table having at least two dies for receiving the work piece;

a transfer system for transferring the work piece between the at least two dies;

at least two upper tools installed on a ram head and at least two lower tools installed on a ram foot, wherein the ram head is rigidly connected to the ram foot to form a ram;

wherein:

in a first forming step, the work piece is reshaped by one of the at least two upper tools in one of the at least two dies;

in a first demoulding step, the work piece is removed from the one of the at least two dies by one of the at least two lower tools;

in a transfer step, the work piece is aligned by the transfer system to another one of the at least two dies;

in a second forming step, the work piece is reshaped by another one of the at least two upper tools in another one of the at least two dies; and in a second demoulding step, the work piece is removed from the another one of the at least two dies by another one of the at least two lower tools.

2. The transfer press according to claim 1, wherein the ram head and the ram foot by means of two side parts are rigidly interconnected.

3. The transfer press according to claim 2, wherein the ram head, the ram foot and the press table are present in one plane and the side parts have a C-shape, so that the side parts are guided from the ram head to the ram foot in front of or behind the press table.

4. The transfer press according to claim 2, wherein each of the side parts of the ram has a key for displacing the ram head and/or the ram foot in depth, and a pivot point about which the ram head and/or the ram foot around a horizontal axis.

5. The transfer press according to claim 1, wherein a ratio of a width to a height of the ram is 1 to at least 0.5.

6. The transfer press according to claim 1, wherein the transfer press has a central drive motor as a starting point of a drive train, which controls a movement of the ram via at least one connecting rod.

7. The transfer press according to claim 6, wherein two connecting rods on the ram head are installed and transmit a movement of the drive train to the ram.

8. The transfer press according to claim 1, wherein the ram head and the ram foot are guided in a press frame by means of linear bearings.

9. The transfer press according to claim 8, wherein the linear bearings are roller circulating units.

10. The transfer press according to claim 1, wherein the transfer press comprises four linear bearings which each guide the ram head and the ram foot laterally in a press frame.

11. The transfer press according to claim 1, wherein the ram is adjustable without backlash in a press frame by means of lateral wedge adjustments.

12. The transfer press according to claim 1, wherein the transfer system comprises a swing body.

13. The transfer press according to claim 1, wherein the transfer press comprises at least two groups with at least two upper tools and at least two groups with at least two lower tools that are aligned therewith, so that the transfer press can process work pieces in at least two tracks simultaneously.

14. The transfer press according to claim 1, wherein the transfer press is capable of forming bowl-shaped work pieces made of sheet metal.

15. A method for using a transfer press according to claim 1 for forming cup-shaped work pieces made of sheet metal, comprising:

a first forming step, wherein the work piece is formed by one of the at least two upper tools;

a first demoulding step, wherein the work piece is demoulded from the the one of the at least two dies by the one of the at least two lower tools;

a transfer step, wherein the work piece is aligned by the transfer system toward another one of the at least two dies;

a second forming step, wherein the work piece is formed in the another one of the at least two dies by another one of the at least two upper tools in the another one of the at least two dies; and a second demoulding step, wherein the work piece is demoulded from the another one of the at least two dies by another one of the at least two lower tools.

16. A method of making cartridge cases comprising utilizing the transfer press according to the claim 1.

* * * * *